US005397023A

United States Patent [19]

Toczek et al.

[11] Patent Number: 5,397,023

[45] Date of Patent: Mar. 14, 1995

[54] DISPOSABLE CUP LID HAVING A TEAR-RESISTANT STRAW THROUGH-SLIT

[75] Inventors: Thomas R. Toczek, Nazareth, Pa.; Jonathan E. Rush, Phillipsburg, N.J.; Michael T. Grolemund, Easton, Pa.

[73] Assignee: James River Corporation of Virginia, Richmond, Va.

[21] Appl. No.: 161,599

[22] Filed: Dec. 6, 1993

[51] Int. Cl.[6] ..... B65D 51/00

[52] U.S. Cl. ..... 220/709; 220/229; 220/268; 215/1 A; 215/229

[58] Field of Search ..... 220/229, 265, 266, 268, 220/277, 705, 709, 713; 215/1 A, 229; 229/103.1

[56] References Cited

U.S. PATENT DOCUMENTS

| | | | |
|---|---|---|---|
| 4,053,084 | 10/1977 | Anderson | 220/229 |
| 4,245,752 | 1/1981 | Prucher . | |
| 4,350,260 | 9/1982 | Prucher . | |
| 4,438,865 | 3/1984 | Scattaregia | 220/270 |
| 4,502,608 | 3/1985 | Mills . | |
| 4,948,009 | 8/1990 | Sawatani | 220/229 |
| 4,999,230 | 3/1991 | Pipkins . | |
| 5,025,947 | 6/1991 | Leone | 220/229 X |
| 5,071,017 | 12/1991 | Stull | 215/260 |
| 5,111,854 | 5/1992 | Begley et al. . | |
| 5,147,065 | 9/1992 | Rush et al. | 220/709 |
| 5,183,172 | 2/1993 | Boller . | |

*Primary Examiner*—Allan N. Shoap
*Assistant Examiner*—Stephen Cronin
*Attorney, Agent, or Firm*—Sixbey, Friedman, Leedom & Ferguson

[57] ABSTRACT

A straw-insertable disposable lid is disclosed including a flexible disk-like body having a top surface for covering an opening of a cup, a plurality of intersecting lines of weakness each extending between two ends with the lines of weakness being located on the body and adapted to permit the insertion of a drinking straw through the top surface of the lid and a plurality of intersecting troughs for accommodating a respective one of the intersecting lines of weakness, with the troughs acting to stop the propagation of the tearing of the lines of weakness in a radially outward direction when a straw is inserted into the lid and for closing the plurality of intersecting lines of weakness in response to a fluid pressure force acting on an underside of the top surface of the lid should a filled cup incorporating such lid be inadvertently tilted over. The aforementioned lid if formed by placing a sheet of thermo-deformable material between a male and female die set, the male die including an edge for forming the plurality of intersecting lines of weakness and the plurality of intersecting troughs in a substantially planar portion of the sheet with each trough accommodating a respective one of the lines of weakness, heating the sheet of thermo-deformable material between the male and female die set and substantially simultaneously forming the plurality of lines of weakness and the plurality of troughs during the formation of the remaining portions of the straw-insertable lids.

15 Claims, 3 Drawing Sheets

DISPOSABLE CUP LID HAVING A TEAR-RESISTANT STRAW THROUGH-SLIT

TECHNICAL FIELD OF THE INVENTION

The present invention relates to an improvement in disposable straw-insertable lids for drinking cups. More particularly, the present invention relates to the formation of a tear-resistant through-slit straw slot in a raised surface of the disposable lid for insertion of a straw therethrough.

BACKGROUND OF THE INVENTION

Disposable plastic straw-insertable lids are well known, and are found in environments where beverages are vended, dispensed or sold for consumption, such as at fast food restaurants. The straw-insert opening facilitates the insertion of a straw into the cup without eliminating the protection provided by the lid against spillage of the cup's contents.

Typically, a straw insert opening comprises two perpendicularly crossing "straw insertion slits" in the lid body. The straw insertion slits may be lines of weakness or may be complete perforations in the lid. The slits create a pattern in the lid of four adjacent wedge-shaped sections with their apexes at a common center point. A drinking straw is pressed against the center point, causing the wedge-shaped sections to be displaced inwardly, thus allowing the straw to pass through the lid and into the cup.

Conventional straw-insertable lids are subject to tipping, which occurs when the application of force during the insertion of a straw actually tears the lid rather than merely displacing the wedge-shaped sections defined by the lines of weakness. Typically, tipping occurs at the ends of the straw insertion slits and extends across the lid in the direction of the straw-insertion slits.

Major consumers of these lids, such as fast-food restaurant chains, demand that the tendency of the lids to rip be minimized. This requirement in the market exists for several reasons. First, tipping of the lid on insertion of the straw is undesirable in that it provides an enlarged opening through which liquid will flow if the cup is tipped, jostled, or overturned. Second, this type of tipping may produce a jagged edge which is sharp and therefor poses a safety hazard. Finally, tipping changes the geometry of the straw insertion slits so that the straw may not be located with its central longitudinal axis at the intersection of the straw insertion slits. When the straw is correctly located, the forces applied to the straw by the wedge-shaped portions of the lid are uniform forces and thus do not tend to crush the straw, but are resisted by the straw's uniform cross section. Mislocation of the straw as a result of tipping results in uneven forces tending to crush the straw and prevent the passage of liquid through the straw. This tendency of the tipped lid to crush the straw is particularly undesirable when a thicker beverage such as a milkshake is being consumed through the straw, since the crushing of the straw may effectively prevent suction of the milkshake through the straw.

The amount of tipping experienced varies with the type of plastic used in the cup lid; more flexible plastics (i.e. having a greater rubber content) such as K-resin crystal tend to rip less than more brittle or rigid plastics, such as high-impact polystyrene. Plastics such as high-impact polystyrene can be produced at lower cost, so it would be desirable to develop a lid design that would not rip even when constructed from high impact polystyrene.

An example of a known lid constructed to reduce ripping of this type is shown generally in FIG. 1. As shown in FIG. 1, lid 101 has a rim 102 which engages a cup rim (not shown). Straw insertion slit 103 comprises lines of weakness or through-slits 104 and 105, which are formed in relatively perpendicular fashion in the lid by stamping or molding. Transverse tip-stop end cuts 106 formed continuously with and perpendicular to the ends of through-slits 104 and 105 tend to reduce the extension of rips or tears past the ends of the through-slits. Stamping of numerous lines of weakness in the lid, as performed in designs of this type, results in a weakening of the planar structure of the lid in the region of the straw-hole. This weakness may result in cracking of the lids during packing and bulk shipment, and also in much less effective sealing of liquids inside the cup.

Another example of a prior art drinking lid device is disclosed in U.S. Pat. No. 4,948,009 to Sawatani, which shows a lid with a protruding outer ring which surrounds the otherwise conventional through-slits. The ring is said to stop fractures starting at an end of a through-slit. Designs of this type have the disadvantage of requiring more material than planar lids. Because these lids are produced in tremendous volumes, the need for even a small amount of additional material in each lid becomes expensive and thus undesirable.

Yet another type of straw-insertable drinking lid is shown in U.S. Pat. Nos. 4,245,752 and 4,350,260 to Prueher and U.S. Pat. No. 4,438,865 to Scattaregia. These references show holes provided at the ends of the intersecting through-slits which could perform a tear-reducing function. Of course, designs of this general type are less effective in keeping liquids inside the cup since liquids can pass through the holes.

U.S. Pat. No. 4,502,608 to Mills discloses a disposable lid for a drinking cup in which a cut is made through the thickness of the lid. The cut functions to terminate the tearing-out of a wedge-shaped piece as it is removed from the cup lid to permit drinking from the cup. U.S. Pat. No. 4,999,230 to Pipkins discloses a sheet with removable sections defined by a series of arcuate cuts which are separated by connection points. The connection points are broken to remove the sections from the sheet.

Further, with each of the above-noted lid configurations, should a filled cup having the lid thereon tip over, the pressure of the fluid within he cup will press against the inner surface of the wedge-shaped sections causing them to spread outwardly and away from one another. In doing so, the fluid can readily pass through the slits thus spilling from the cup. This is likewise true for lids having intersecting lines of weakness in that the fluid pressure may be great enough to overcome the strength of the membrane.

Additionally, when forming the straw slits in the above-noted lid configurations, the slits are formed by a cutting die at a station downstream from the lid formation station which requires that the lid be properly registered with the cutting die at that station. If the lid is not correctly aligned with the cutting die, the lid will be miscut resulting in a defective lid which must be scrapped, thus increasing the costs associated with the production of the lids.

As noted, known designs for disposable cup lids have not been entirely satisfactory. What is needed is a lid that could be manufactured from lower-cost, more brittle plastic, which would effectively hold in liquids prior to insertion of a straw, and which would not fracture in an undesirable manner during shipment, placement on the cup, or upon insertion of a straw. At the same time, an ideal design could be produced without requiring additional material or additional production operations, either of which would make the improved lid more expensive than known lids.

SUMMARY OF THE INVENTION

Accordingly, it is an object of the present invention to provide a novel straw-insertable disposable lid which provides improved protection against cracking or tearing beyond the through-slits caused by packing and shipping, placement of the lid on a cup, or the insertion of a drinking straw into the lid.

It is a further object of the present invention to provide an improved straw-insertable lid which protects against spillage of the container's contents both before and after the straw has been inserted.

Another object of the present invention is to provide an improved straw-insertable lid which can be produced at the same cost as conventional disposable lids containing through-slits.

Yet another object of the present invention is to provide an improved straw-insertable lid made from high-impact polystyrene or similar plastic which does not exhibit undesirable fracturing upon straw insertion.

A further object of the present invention is to provide a straw-insertable lid which has improved tear-resistance but can be produced using the same amount of material as a conventional lid without additional production steps. Moreover, it is an object of the present invention to provide a method for making such a straw insertable lid with a reduction in the steps required for making such lid, and which will assure proper alignment of the through-slits.

These as well as additional objects of the present invention are achieved by providing a straw-insertable lid for a drinking cup including a flexible disk-like body having a top surface for coveting an opening of the cup, a plurality of intersecting lines of weakness each extending between two ends with the lines of weakness being located on the body and adapted to permit the insertion of a drinking straw through the top surface of the lid and thus into the drinking cup and a plurality of intersecting troughs for accommodating a respective one of the intersecting lines of weakness with the troughs acting to stop the propagation of the tearing of the lines of weakness in a radially outward direction when a straw is inserted into the lid and for closing the plurality of intersecting lines of weakness in response to a fluid pressure force acting on an underside of the top surface of the lid should a filled cup incorporating such lid be inadvertently tilted over.

The aforementioned lid being formed by placing a sheet of thermo-deformable material adjacent a die, the die including a raised portion for forming the plurality of intersecting lines of weakness and the plurality of intersecting troughs in a substantially planar portion of the sheet with each trough accommodating a respective one of the lines of weakness, heating the sheet of thermo-deformable material to a deformable temperature, and substantially simultaneously thermoforming the plurality of lines of weakness and the plurality of troughs during the formation of the remaining portions of the straw-insertable lids.

These as well as additional advantages of the present invention will become apparent from the following detailed description when read in light of the several figures.

DETAILED DESCRIPTION OF THE PREFERRED EMBODIMENT

Figure 3:
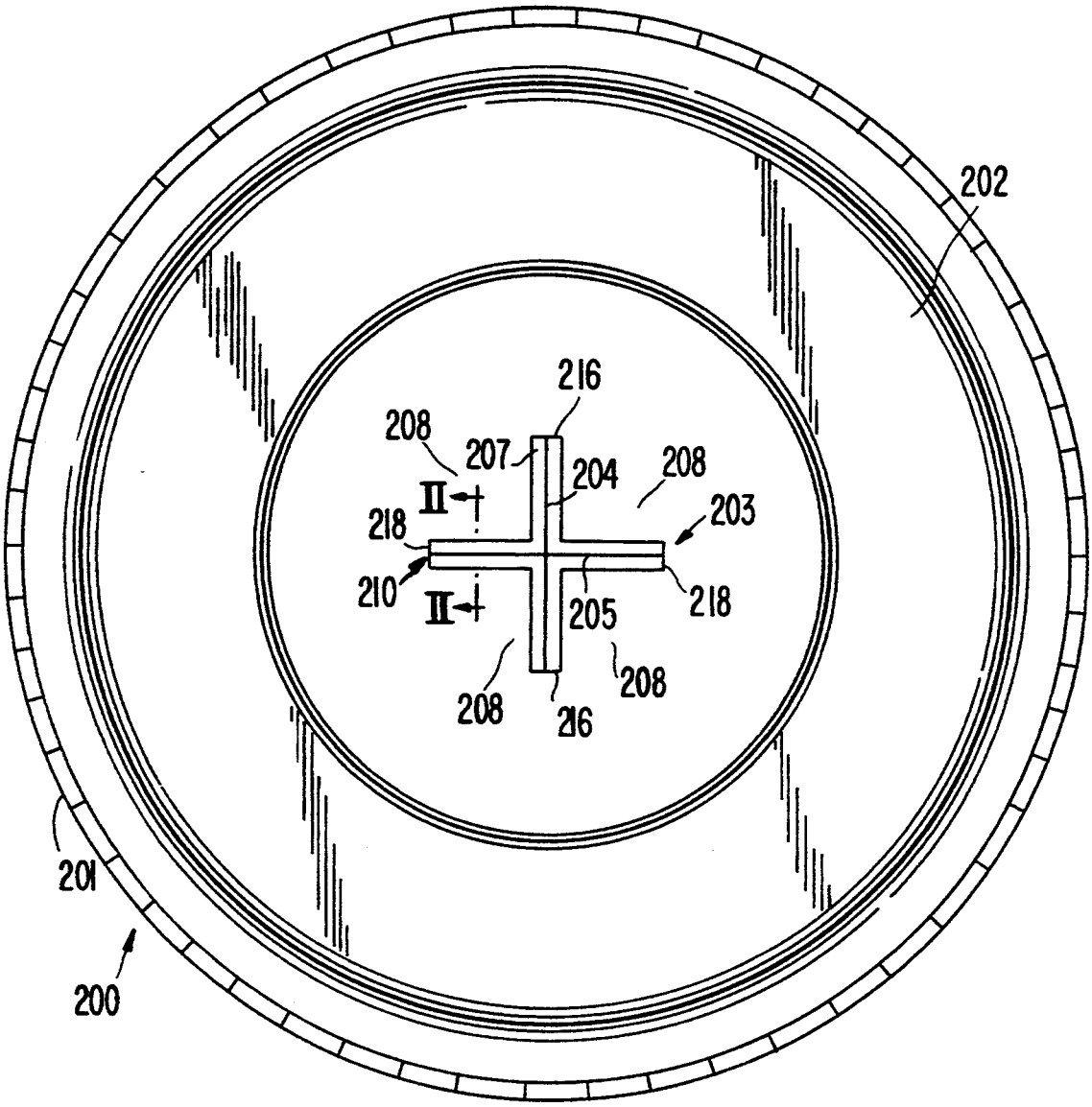
FIG. 3 is a top plan view of a lid in accordance with a preferred embodiment of the present invention.

A preferred embodiment of the present cup lid is shown generally at 200 in FIG. 3. Disposable lid 200 is made of plastic and is designed for use with a conventional drinking cup, not shown. Lid 200 includes a conventional rim 201 designed to engage an opening of the cup to hold lid 200 firmly on the cup. Rim 201 surrounds a disk-like body 202 which covers the cup opening when lid 200 is positioned on the cup.

The body 202 has a straw slot opening 203 which functions as a means for facilitating the insertion of a drinking straw (not shown) into the cup for withdrawing liquid by suction. The straw slot opening 203 comprises two mutually perpendicular slits 204 and 205. The slits 204 and 205 cross at their midpoints at right angles, thus being mutually bisecting. Further, the slits 204 and 205 are sized according to the size of straw to be used, and may typically each be about $\frac{5}{8}$" in overall length. These slits 204 and 205 are situated so as to form a pattern of four adjacent wedge-shaped sections 208 which are typically displaced inwardly during the insertion of the straw into the straw slot opening 203.

Formed at substantially the same time as the slits 204 and 205 are troughs 207 and 210 which accommodate slits 204 and 205 respectively. The troughs 207 and 210 are thermoformed during the formation of remaining portions of the lid configuration. The particular structure of the male die used in the thermoforming process will be discussed in greater detail hereinbelow.

As noted, the slits 204 and 205 and troughs 207 and 210 are formed at substantially the same time as the remaining structural portions of the lid configuration. That is, a sheet of thermo-deformable material is placed in a predetermined position with respect to a die element in a known manner for forming lids of this nature. The thermo-deformable material is either previously heated or subsequently heated to a deformable temperature in order to substantially simultaneously thermoform the rim 201, body 202, slits 204 and 205 and troughs 207 and 210.

Figure 1:
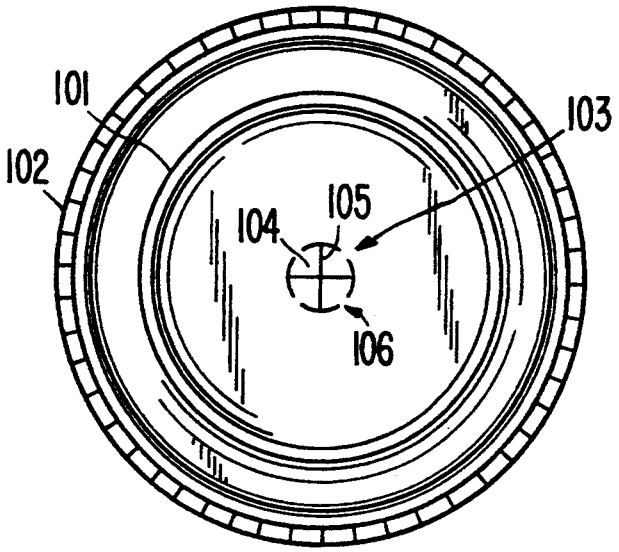
FIG. 1 (PRIOR ART)
FIG. 1 is a top plan view of a known lid.
Figure 2:
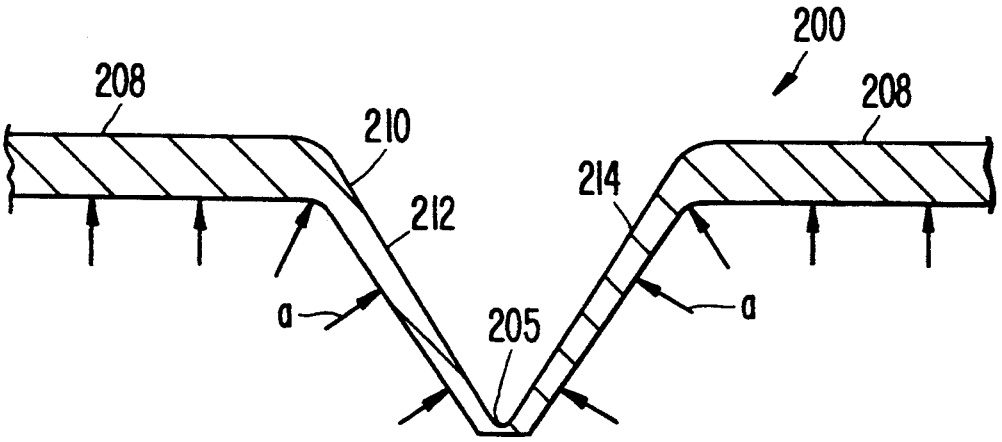
FIG. 2 is a cross-sectional view of the lid in accordance with the present invention taken along line II—II of FIG. 3.

When formed, the troughs take on the configuration substantially as illustrated in FIG. 2. The trough 210 includes depending wall portions 212 and 214 which converge toward one another to the slit 205. As can been seen from FIG. 2, the slit 205 may be either a through cut score, or, in this case, a significantly thinned region which provides only a membrane of material which is easily broken upon insertion of a straw into the straw slot opening 203. The walls 212 and 214 are inclined at an angle in a range of approximately 40° to 70° to the horizontal, thus resulting in an angle in the range of approximately 40° to 100° between the walls 212 and 214.

The troughs 207 and 210 prevent the wedge-shaped sections 208 from swinging outward under fluid pressure in the event the cup is overturned in a "transportation phase" of cup use, after the lid is mounted on the cup but before the straw has been inserted. Typically, in a fast-food restaurant, drinks are provided at the service counter with lids installed and carried on a tray to a seating area or passed to an automobile, where the straw is inserted and the drink is consumed. If a cup is overturned during this transportation phase, it is desired that no liquid escape through the yet-unused straw hole. Further, once used, if the straw is removed it is still advantageous to provide a straw hole which will resist leakage. That is, one which is capable of closing itself in response to internal fluid pressure.

Once the lid 200 is placed on a cup containing a liquid and the rim 201 cooperates with the brim of the cup, the lid will be secured over the opening of the cup. Should the filled cup accidentally fall on its side, fluid pressure forces will act on an undersurface of eh lid 200. These fluid pressure forces are exhibited by arrows "a" in FIG. 2. As can be seen from the arrows "a", the dependent walls 212 and 214 are forced towards one another particularly in the region of the slit 205 which in effect forces the slit 205 closed, unlike the prior art configurations. With the prior art configurations, when fluid pressure forces act on an underside of a substantially planar lid with the through-slits being formed in the top plane of the lid, the fluid pressure forces would tend to push the material outwardly and thus spread the through-slits apart, thus possibly resulting in a leakage of the contents of the cup. Accordingly, with the above-noted trough-slot configuration, leakage of the contents of the cup through the lid can be eliminated particularly before the straw is inserted into or after the straw is removed from the cup.

Additionally, because the slits 204 and 205 are formed in the bottom of the trough, when a straw is inserted into the straw slot opening 203, opening of the slits 204 and 205 will the from the apex where the slits cross one another radially outward toward the rim of the lid. While the pre-cut portion of the slits 204 and 205 end in the region of the end of the trough with prior art disposable type lids, the propagation of the slit often continues into the planar surface of the lid resulting in the deficiencies discussed hereinabove in the background portion of the invention.

In the present invention, because each of troughs 207 and 210 include end walls 216 and 218 respectively, a means of protecting against extended fracture, cracking or tearing of the through-slits 204 and 205 which may be caused by the insertion of a drinking straw into the straw slot opening 203 of the lid 200 is provided. Specifically, when a straw is inserted into the through-slits 204 and 205, the wedge-shaped sections 208 are deflected into the interior of the cup and permit the straw to pass therethrough. Due to the configuration of the troughs 207 and 210, a momentary countering force is created to center the straw in the through-slits 204 and 205 by the end walls 216 and 218. If the force used to insert the straw is excessive, the end walls 216 and 218 provide a structure which redirects and absorbs the tearing forces to prevent extended tears across the body 202. The momentary excessive force will be absorbed by the end walls 216 and 218. That is, the radial propagation of the tear will reach the end walls 216 and 218 which causes the radial force to be redirected upwardly which prevents continued tearing of the through-slits 204 and 205.

This structural reinforcement provided by the troughs 207 and 210 also results in improved performance during packing and bulk shipment of the lids 200. When brittle plastics such as high-impact polystyrene are used to form the lids 200, packing and shipping operations can result in cracking in the central planar area of weakness in body 202 created by the provision of straw slot opening 203. Troughs 207 and 210 add structural reinforcement to the central region of body 202 of the lid 200 during packing and shipping, but the flexible nature of the troughs 207 and 210 still permits slits 204 and 205 to function in the desired manner upon insertion of a straw into the lid 200.

As noted previously, slits 204 and 205 and troughs 207 and 210 are preferably constructed in the same thermoforming operation used for the formation of the remaining portions of the lid. That is, at the same time the rim 201 of the lid is formed.

Figure 4:
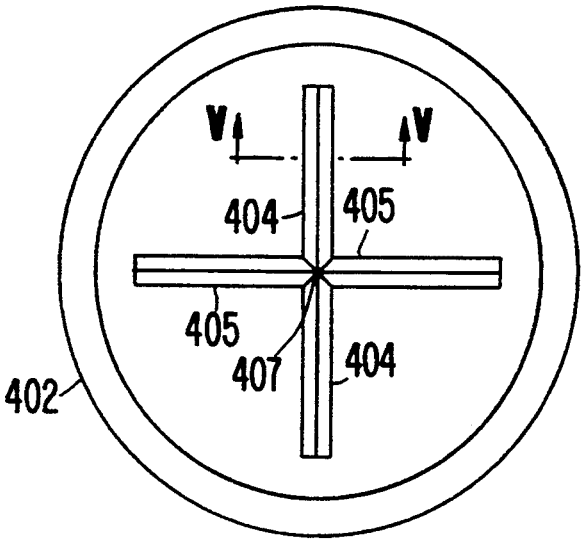
FIG. 4 is a top view of a die element useful in constructing the lid of the present invention.

FIG. 4 shows a die element 402 which may be used to form the slits and troughs of the lid illustrated in FIG. 3. This die 402 is used in a along with otherwise conventional thermoforming equipment in a lid thermoforming process such as is conventionally performed to create the remaining features molded into plastic disposable cup lids such as the rim 201. The die 402 may be constructed from a standard blank such as a BP 75×2.00 A2 blank sold by Danly Machine Corp. of Chicago, Ill. Further, the die may be readily added to the present thermoforming dies for the formation of disposable cup lids.

The die 402 has projections 404 designed to form slits 204 and trough 207. Projections 405 will likewise form the slits 205 and trough 210 shown in lid 200 of FIG. 3. Die 402 is generally circular, with a center 407 and as discussed hereinabove it is to be positioned in a conventional die for forming disposable cup lids at the position on the lid surface where it is desirable to have the straw slot opening 203 formed. Dimensions of the die for a preferred embodiment will be given, although the dimensions may be varied as desired to produce larger or smaller slits and troughs. In the preferred embodiment, projections 404 and 405 extend approximately 0.312 inches from the center 407; however, this dimension may vary dependent upon the size of the trough desired.

Figure 5:
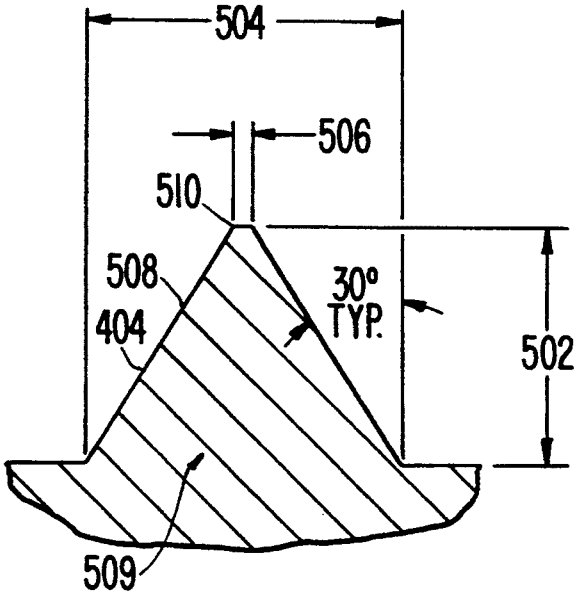
FIG. 5 is a cross-sectional view along line V—V of the die element of FIG. 4.

FIG. 5 is a cross-sectional view of the die 402 of FIG. 4 showing the cross-sectional configuration of projections 404 and 405. In the preferred embodiment, the projections will have a generally trapezoidal-shaped cross section with a base 509, cutting edge 510, and sides 508. The cross section has a height 502 of approximately 0.040 inches, a base width 504 of approximately 0.048 inches, and top or cutting edge width 506 of approximately 0.002 to 0.003 inches. The sides 508 of the projections will slope between the base 509 and the cutting edge 510 at approximately 30 degrees from the vertical, as shown. As can be seen with reference again to FIG. 4, the ends of projections 404 and 405 are substantially perpendicular to the base 509 of the die; however, the ends 404 and 405 may be inclined between cutting edge 510 and base 509. This would result in the forming of inclined end walls 216 and 218.

While the present invention has-been described with reference to a preferred embodiment, it should be appreciated by those skilled in the art that the invention may be practiced otherwise than as specifically prescribed herein without departing from the spirit and scope of the invention. It is therefore, to be understood that the spirit and scope of the invention be limited only by the pending claims.

INDUSTRIAL APPLICABILITY

The above described combination trough and through-slit straw slot can be formed in any region of the top surface of a disposable lid where access to the contents of the cup by a straw is desired. Such a configuration provides increased resistance to leakage and tears in the lid without adding to the manufacturing costs associated with such a disposable lid.

I claim:

1. A straw-insertable lid for a drinking cup comprising;

a flexible disk-like body having a top surface;

a plurality of intersecting lines of weakness each extending between two ends, said lines of weakness located on the body and adapted to permit the insertion of a drinking straw through said top surface and thus into the drinking cup; and a plurality of intersecting troughs each one of said troughs for accommodating a respective one of said intersecting lines of weakness.

2. The lid of claim 1, wherein said intersecting lines of weakness are formed in a base of said trough.

3. The lid of claim 1, wherein two of said lines of weakness intersect perpendicularly and two of said troughs intersect perpendicularly.

4. The lid of claim 1, further comprising a tear-stopping means for stopping propagation of the tearing of said lines of weakness in a radially outward direction when a straw is inserted into the lid.

5. The lid of claim 4, wherein said tear-stopping means is an end wall of each of said plurality of troughs.

6. The lid of claim 1, wherein said lines of weakness are cut score lines formed in a base of said respective troughs.

7. A straw-insertable lid for a drinking cup comprising;

flexible disk means for covering an opening of the cup, said means having a top surface; and straw receiving means located on the flexible disk means comprising a plurality of intersecting troughs formed in said flexible disk means, each trough accommodating a respective one of a plurality of intersecting lines of weakness for permitting the insertion of a drinking straw through said top surface and thus into the drinking cup.

8. The lid of claim 7, wherein said intersecting lines of weakness are formed in a base of said troughs.

9. The lid of claim 8, wherein there are two of said intersecting lines of weakness and two of said intersecting troughs.

10. The lid of claim 7, further comprising a tear-stopping means for stopping propagation of the tearing of said lines of weakness in a radially outward direction when a straw is inserted into the lid.

11. The lid of claim 10, wherein said tear-stopping means is an end wall of each of said plurality of troughs.

12. The lid of claim 7, wherein said lines of weakness are cut score lines formed in a base of said respective troughs.

13. A straw-insertable lid for a drinking cup comprising;

a flexible disk-like body having a top surface;

a plurality of intersecting cut score lines formed in said top surface for permitting insertion of a drinking straw through said top surface and into the drinking cup; and a plurality of intersecting troughs, each said trough accommodating a respective one of said plurality of intersecting cut score lines.

14. The lid as defined in claim 13, wherein each of said intersecting cut score lines are formed in a base of said respective trough.

15. The lid as defined in claim 14, wherein side walls of said trough are forced towards one another in response to the fluid pressure force acting on the underside of said top surface.

* * * * *